US009884335B2

(12) United States Patent
Marelli

(10) Patent No.: US 9,884,335 B2
(45) Date of Patent: Feb. 6, 2018

(54) HAND HELD DISPENSER

(71) Applicant: MeadWestvaco Calmar S.R.L., Norcross, GA (US)

(72) Inventor: Andrea Marelli, Milan (IT)

(73) Assignee: SILGAN DISPENSING SYSTEMS MILANO S.R.L., Zibido San Giacombo (MI) (IT)

( * ) Notice: Subject to any disclaimer, the term of this patent is extended or adjusted under 35 U.S.C. 154(b) by 0 days.

(21) Appl. No.: 14/906,792

(22) PCT Filed: Jul. 9, 2014

(86) PCT No.: PCT/IB2014/062974

§ 371 (c)(1),
(2) Date: Jan. 21, 2016

(87) PCT Pub. No.: WO2015/011593

PCT Pub. Date: Jan. 29, 2015

(65) Prior Publication Data

US 2016/0167072 A1 Jun. 16, 2016

(51) Int. Cl.
*B05B 11/00* (2006.01)

(52) U.S. Cl.
CPC ..... *B05B 11/304* (2013.01); *B05B 11/0064* (2013.01); *B05B 11/3001* (2013.01); *B05B 11/3047* (2013.01); *B05B 11/3061* (2013.01)

(58) Field of Classification Search
CPC ..... B05B 11/304; B05B 11/0064; B05B 11/3001
USPC ..... 222/321.9
See application file for complete search history.

(56) References Cited

U.S. PATENT DOCUMENTS

| | | | | |
|---|---|---|---|---|
| 4,071,172 | A * | 1/1978 | Balogh | B05B 11/3001 222/321.7 |
| 4,921,017 | A * | 5/1990 | Tada | B05B 11/0064 137/843 |
| 4,991,747 | A * | 2/1991 | Van Brocklin | B05B 11/3001 222/321.3 |
| 5,401,148 | A * | 3/1995 | Foster | B05B 11/0064 222/153.13 |
| 5,649,649 | A * | 7/1997 | Marelli | B05B 11/3061 222/321.1 |
| 5,664,703 | A * | 9/1997 | Reifenberger | B05B 11/0016 222/207 |
| 6,170,713 | B1 * | 1/2001 | Schultz | B05B 11/3001 222/321.2 |
| 6,286,726 | B1 * | 9/2001 | Marelli | B05B 11/0064 222/321.2 |

(Continued)

FOREIGN PATENT DOCUMENTS

| | | |
|---|---|---|
| EP | 0721803 A2 | 7/1996 |
| EP | 1033174 A1 | 9/2000 |
| WO | WO 00/24652 A1 | 5/2000 |

*Primary Examiner* — Nicholas J Weiss
*Assistant Examiner* — Michael J Melaragno
(74) *Attorney, Agent, or Firm* — Barlow, Josephs & Holmes, Ltd.

(57) ABSTRACT

A manually operated pump (1) for dispensing a fluid substance in which the movable element (16) of the delivery valve has an at least partially conical surface adapted to be coupled with a corresponding surface of a seat of the delivery valve, in a manner so as to be fit therein due to the action of the spring (10) that loads the movable element (16).

12 Claims, 10 Drawing Sheets

(56) References Cited

U.S. PATENT DOCUMENTS

| | | | | |
|---|---|---|---|---|
| 2004/0094578 | A1* | 5/2004 | Bougamont | B05B 11/0064 222/209 |
| 2007/0256748 | A1* | 11/2007 | Brahim | B05B 11/3067 137/854 |
| 2010/0224653 | A1* | 9/2010 | Donnette | B05B 11/3025 222/321.9 |
| 2016/0167072 | A1* | 6/2016 | Marelli | B05B 11/3047 222/380 |

* cited by examiner

HAND HELD DISPENSER

The present invention refers to a manually operated pump for dispensing fluid substances, provided with a facilitated operation.

In particular, the present invention refers to a pump that can be associated with a container, in which the fluid substance to be dispensed is preserved.

Various types of manually operated pumps have been known for some time.

EP 0065 214 A2 describes a pump with particularly simple operation, obtained for being mounted very easily, with limited cost.

Such pump comprises a cup-shaped body that has, on its bottom, a hole and a boss connected to a drawing tube. The hole obtained on the bottom of the cup-shaped body is associated with a suction valve, which is obtained by a spherule housed in a suitable seat on said bottom. Such spherule is maintained in position by a system of flexible tabs for its insertion in the seat.

Within the cup-shaped body, a piston is situated that has a lip adapted to make a seal on the internal surface of the cup-shaped body. The piston has a step, against which a first end of a return spring is abutted. A second end of such spring is instead abutted against the bottom of the cup-shaped body in proximity to the suction valve.

An internally hollow stem extends from the piston, for actuating the pump. A second spherule is contained in the cavity of the stem, such spherule abutted against a suitable conical housing; such second spherule constitutes a delivery valve of the pump. Such second spherule is loaded by a main spring interposed between a perforated stop fit on the top of the stem and the spherule itself.

Positioned on the stem is a dispenser cap provided with a cavity for the outflow of the fluid and with a head adapted to be pressed in order to actuate the pump.

The cup-shaped body is suitably and sealingly associated with a ring nut dedicated to fixing the pump on a container that contains the fluid substance intended to be dispensed by the pump.

When the entire pump, suitably associated with a container and in use conditions, is placed in a reduced pressure environment, it has been shown that the delivery valve has some leaks, which are quite troubling.

In order to remedy such problem, it has been thought to increase the pressure generated by the spring on the sphere that forms the delivery valve. While this solved the problem of the leaks, it introduced a factor of considerable inconvenience for the user.

Indeed, by increasing the load of the delivery spring, the force necessary for the actuation of the pump (FTA—Force to actuate) is also considerably increased and in such conditions the dispenser button is too 'hard' to press for the dispensing.

Object of the present invention is to obtain a manually operated pump for dispensing fluid substances, which does not have leaks from the delivery valve and which at the same time results easy to actuate for a user (Low FTA).

These and other objects are achieved by obtaining a manually operated pump according to the technical teachings of the enclosed claims.

A further advantage of the present invention is to obtain a pump that can be easily and quickly assembled, without having to possess overly sophisticated mounted equipment.

Not least object of the present invention is to provide a pump that is reliable and durable in use as well as inexpensive to produce.

Further characteristics and advantages of the invention will be evident from the description of a preferred but not exclusive embodiment of the manually operated pump, illustrated as a non-limiting example in the enclosed drawings, in which.

Figure 1:
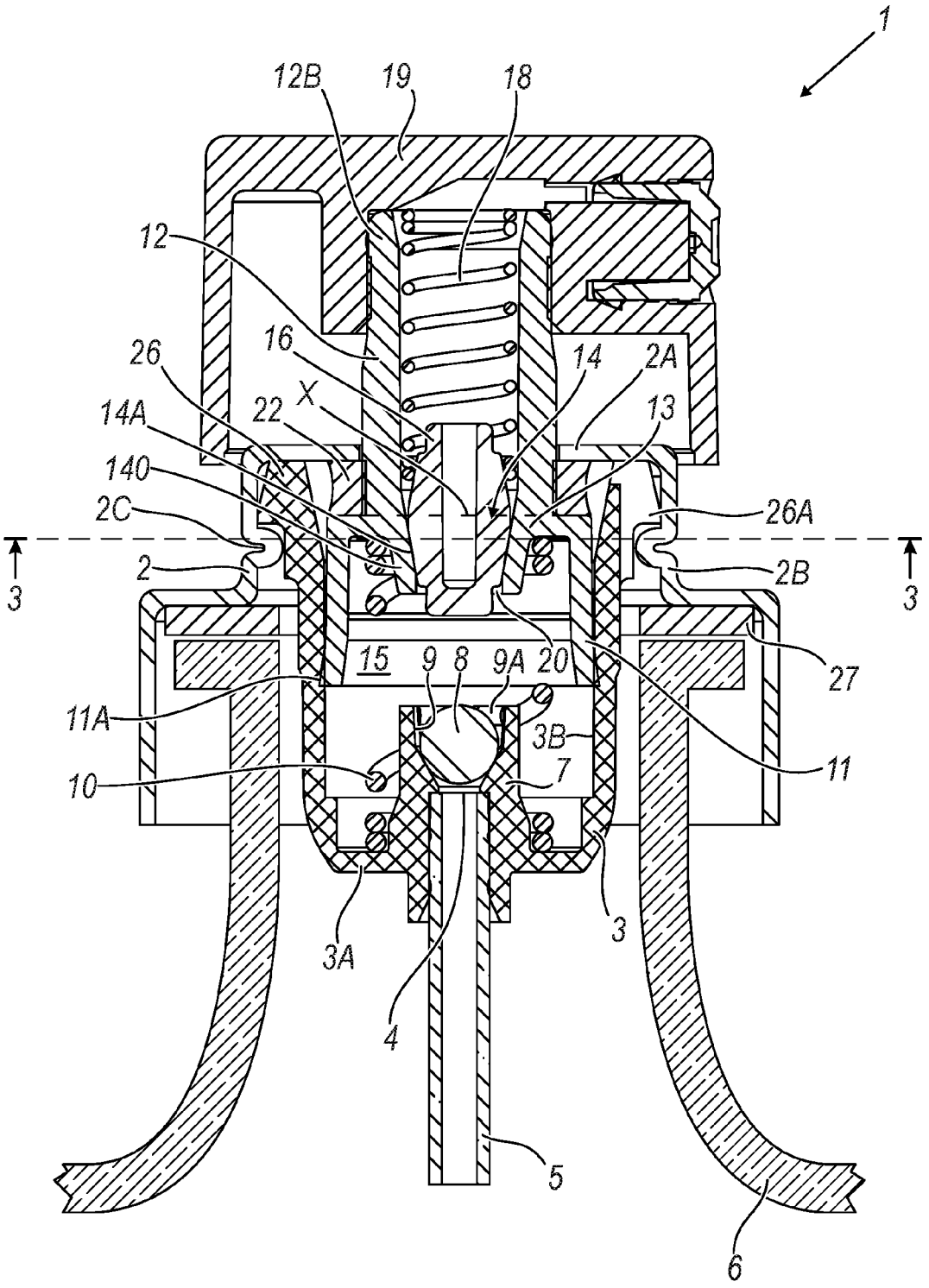
FIG. 1 is an axial section view of the pump of the present innovation, when in a rest position (or upper end of travel)

With reference to the abovementioned figures, a manually operated pump is shown, indicated overall with the reference number 1.

As can be immediately observed from the figures, the pump in question has a very simple structure, and is formed by a very limited number of suitably molded pieces. It can thus be easily assembled.

The manually operated pump 1 is intended to dispense a fluid substance contained inside a container 6 (only partially shown), to which said pump can be associated by means of a suitable bottom 2 (or ring nut), which will be described hereinbelow.

The pump comprises a cup-shaped body 3 provided on its bottom 3A with an opening 4 associable in a known manner with a drawing tube 5 inside said container 6.

From the bottom of the cup-shaped body, an internally hollow cylindrical element 7 departs in the direction opposite the tube; such cylindrical element 7 has at its top a first seat 9 shaped substantially frustoconically (converging towards the opening 4, and hence towards the bottom of the cup-shaped body), in which a spherule 8 is housed. The first spherule 8 and its first seat 9 form a suction valve of the pump 1.

Inside the cup-shaped body 3, a sealing piston 11 is slidable (on the internal surface 3B of the cup-shaped body), in opposition to a return spring 10 only partially shown and interposed between the piston and the bottom of the cup-shaped body. From the piston 11, a hollow stem 12 is extended, one end 12B thereof projecting towards the exterior of the cup-shaped body, through the ring nut or bottom 2.

In the present embodiment, the stem and the piston are obtained in a single piece, via molding of plastic material, preferably made of PE. The piston is advantageously provided with a single sealing lip.

The cavity of the stem is connected with a compression chamber 15 of the pump which is defined by the part of the piston 11 directed towards the bottom of the cup-shaped body 3, and by the cup-shaped body 3 itself.

The hollow stem 12, at a portion 13 thereof of connection with the piston 11, has a second seat 14 obtained by a wall 140 defining on the lower part an opening 20. Such wall 140 is projecting towards the compression chamber 15 and defines a substantially frustoconical surface 14A, converging towards said compression chamber, against which a movable element 16 is abutted. Preferably the frustoconical surface has an opening comprised between 17° and 22°, preferably 20°.

The second seat 14 and the movable element 16, sealingly cooperating, act as a delivery valve of the pump.

It should be noted that the movable element 16 is loaded by a spring 18 placed in the cavity of the stem 12 and which has a first end abutted thereon, and another end abutted against a surface suitably provided on a dispenser button 19 fit on the end 12B of the stem 12. The dispenser button preferably has an insert 21 that acts as a spray nozzle.

Figure 4:
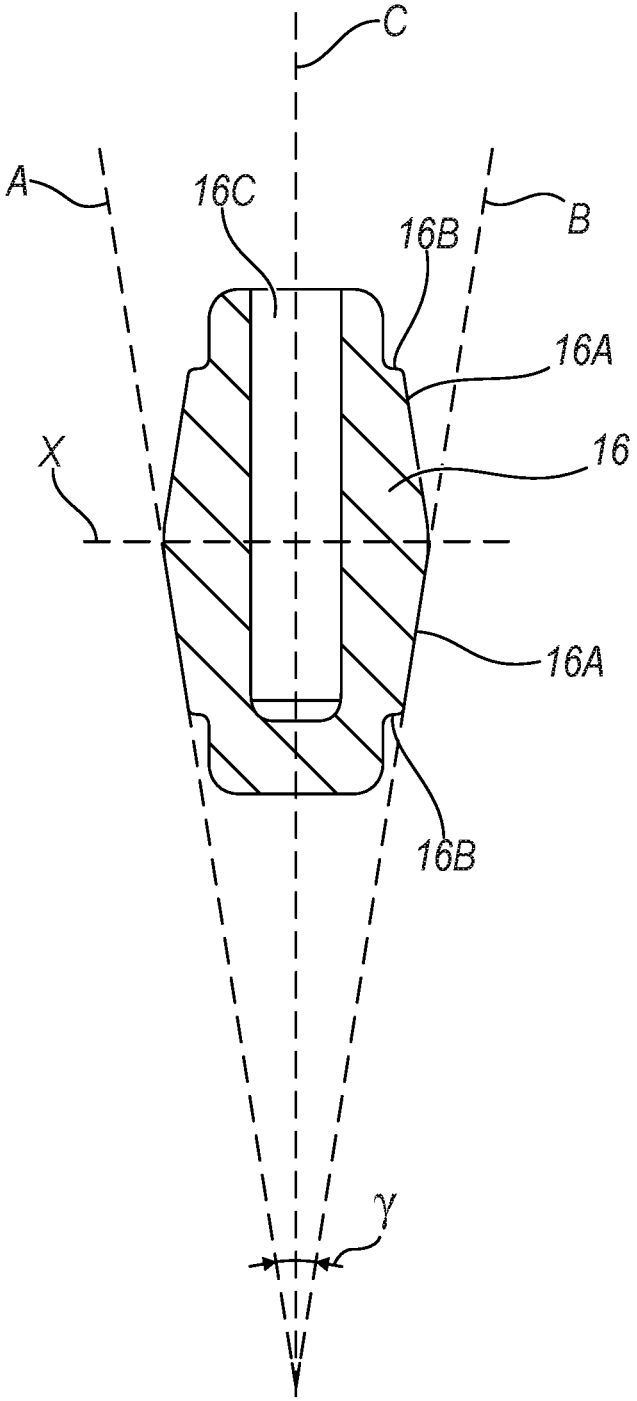
FIG. 4 is a section view of a detail of the pump of FIGS. 1 and 2.
Figure 5:
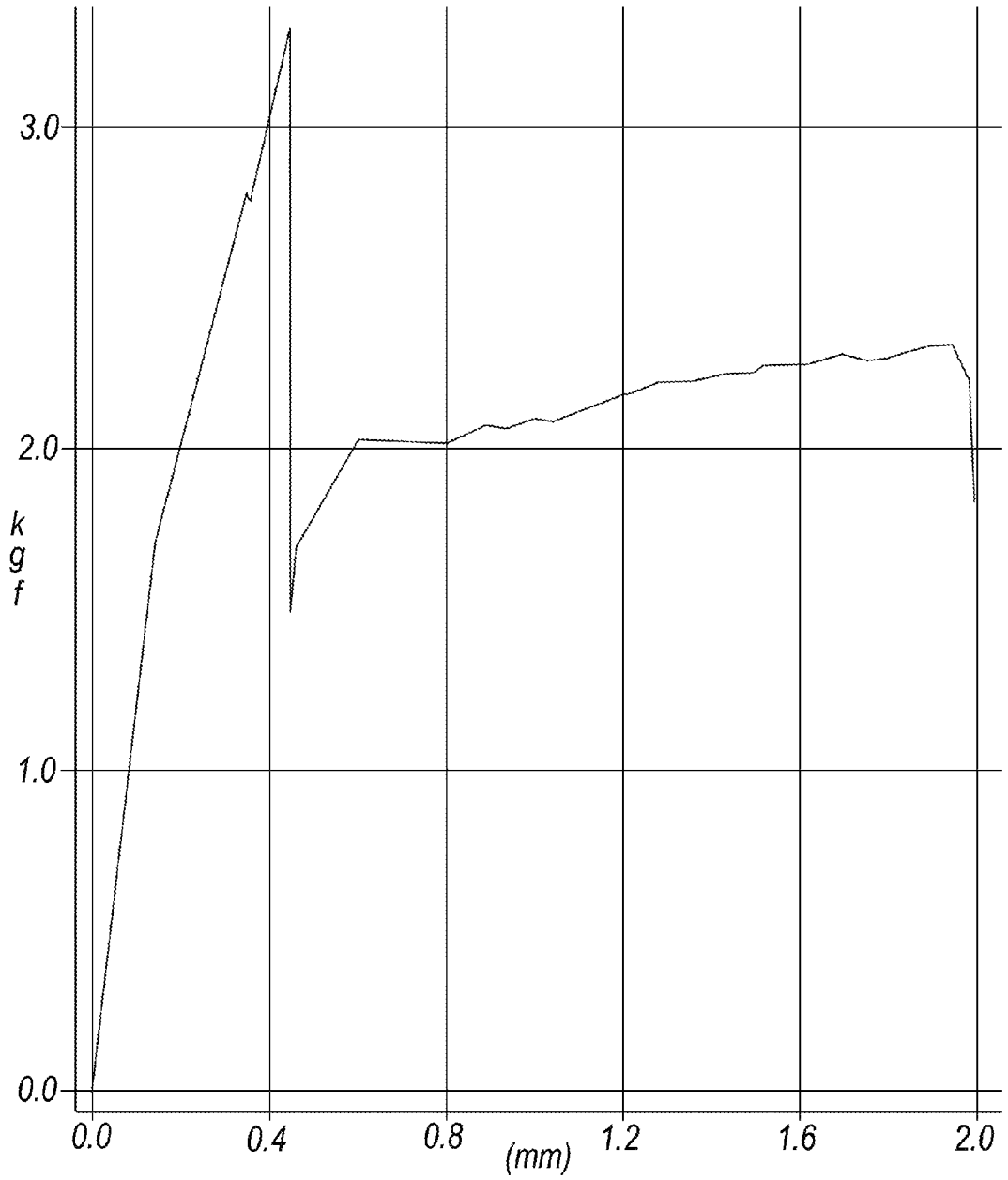
FIG. 5 shows a graph of the force to actuate a pump similar to that of FIG. 1 but when the opening of the conical surface is equal to 15°.
Figure 6:
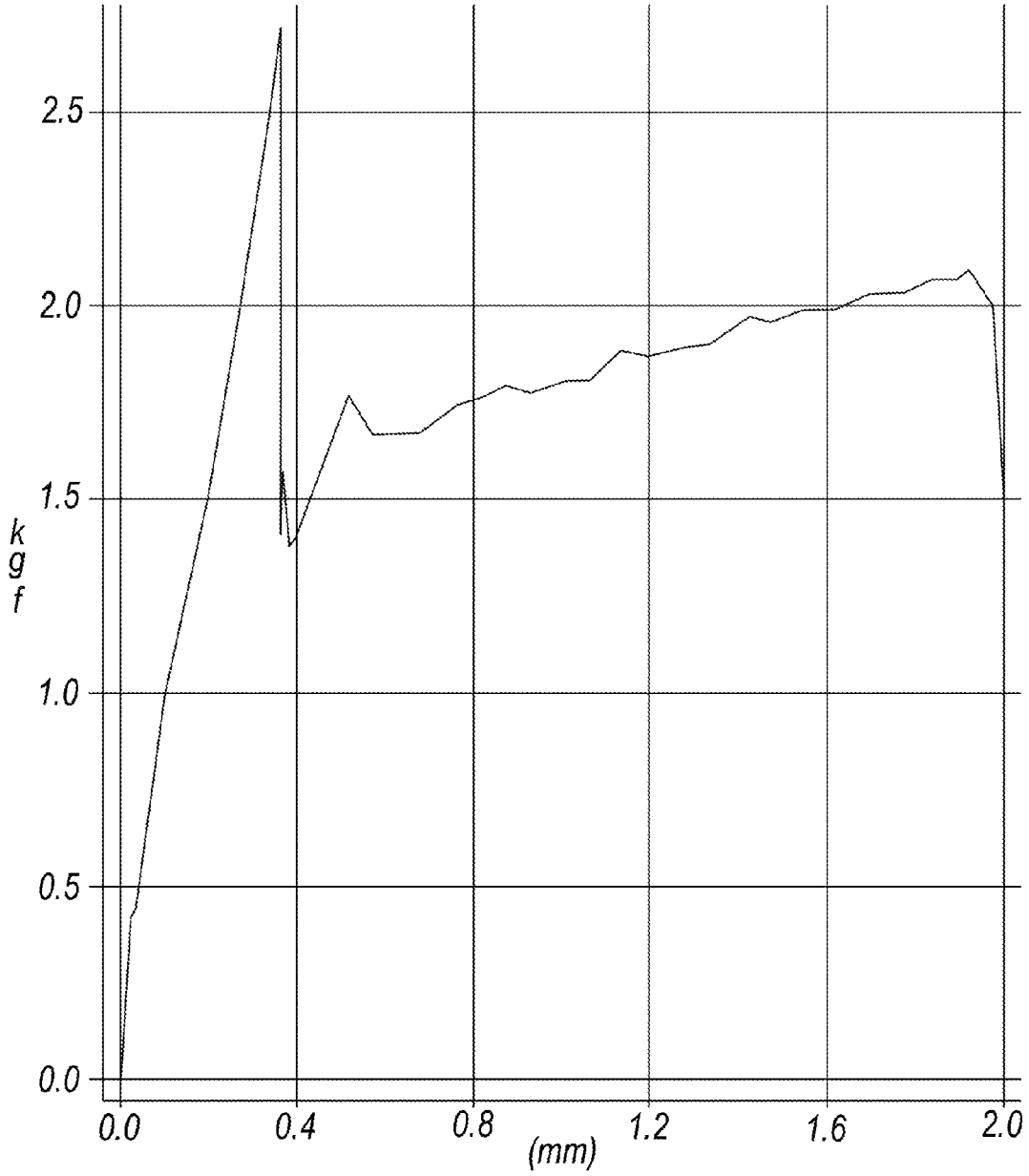
FIG. 6 shows a graph of the force to actuate a pump similar to that of FIG. 1 when the opening of the conical surface is equal to 17°.

The movable element 16 is better illustrated in FIG. 4, where all of its particular features can be appreciated. It is preferably obtained via molding of plastic material (e.g. polyethylene resin sold by DOW Chemicals with the commercial name DOWLEX 2552E, or with a plastic material with a Shore D hardness comprised between 46 and 50, preferably 48, measured according to ASTM D2240) in a single piece. As can be observed, the element 16 has an external surface substantially formed by two frustoconical parts 16A joined at a transverse plane of symmetry X of the element. The symmetry is not perfect, given that—as can be seen from the section—the element 16 has a central lightening 16C actually constituted by a blind hole obtained via molding.

The hole is particularly useful for preventing risks of suction during the steps of molding the movable element.

The frustoconical parts at the ends of the movable element 16 are tapered and have a step 16B of passage between the tapered portion and the frustoconical part.

The step is quite useful since—when the movable element is raised even only slightly during dispensing—the dispensing opening results quite wide and allows a considerable flow of product to be dispensed.

The angle γ or opening (represented in the figure) which defines the conical surfaces, for the purposes of the invention is comprised between 17° and 22°, preferably 20° (deg). It has in fact been verified that this interval of opening angles results optimal for the operation of the pump, as will be described hereinbelow with the aid of the graphs of FIG. 5-9.

It should be observed that for such opening angles, the presence of the step 16B is extremely important. Indeed, without the step, the smaller the opening angle of the 'cone', the smaller the opening for the fluid given the same 'lift' of the movable element. The presence of the abovementioned step provides a passage opening (between the seat of the delivery valve and the movable element) which is wide even in the case of opening angles of the conical surfaces that are rather small, like those described.

The 'functional symmetry' of the element 16 is very important for the mounting. Indeed, it does not require being oriented when it is positioned in the seat 14 before the delivery spring 18, nor does it matter if it falls in the stem 12 with the opening of the lightening hole upward or downward. With the term 'functional symmetry' in the present text, it is intended the symmetry of those conical surfaces intended to make the seal in the seat.

The dispenser button 19 has a normal sealing coupling by interference, preferably with the external surface of the stem 12. It is also provided with a spray nozzle.

As can be seen from the drawings, a gasket 22 is fixed on the external surface of the stem 12, at the piston 11. Such gasket is positioned on an enlargement or annular groove 23 suitable obtained on the surface of the stem.

Such gasket 22—which according to its height also allows an adjustment of the piston travel, and thus of the volume of the compression chamber—when the pump is in a rest position (represented in FIG. 1) is in abutment against the bottom 2 (or ring nut). The bottom has a hole 2A through which the stem 12 passes and a neck 2B seamed in 2C to an annular abutment 26 obtained at a free end of said cup-shaped body 3.

It should be noted that the annular abutment 26 has a notch 26A adapted to allow the passage of the air from the outside to the inside of the container (venting), at least when said gasket is detached from said bottom (i.e. during the travel of the piston).

Advantageously the bottom or ring nut 2 is simply formed by a thin plate of metal material, preferably aluminum, suitably shaped and folded during mounting in order to lock the pump 1 to the container 6.

As can be seen in FIG. 1, the ring nut or bottom (which in such representation is not yet locked to the container 6) has a cylindrical portion that surrounds the neck 6A of the container and which once suitably deformed, engages as an undercut on the neck of the bottle.

Between the container 6 and the ring nut 2 or bottom, a conventional sealing gasket 27 is suitably inserted.

As can be clearly seen in FIG. 1, which represents the pump in rest position, the second seat 14 and the movable element 16 are configured in a manner such that, when the element 16 is in closure position, it partially projects from the second seat 14 itself towards the bottom of the cup-shaped body (inside the compression chamber). Advantageously, in the represented embodiment, it is the tapered end portion of the movable element that projects from the seat 14.

When the piston is at the end of travel (see FIG. 2), the movable element 16 (and specifically a portion thereof projecting from the second seat 14, which substantially corresponds with the tapered portion) comes into contact with the spherule and is lifted in opposition to the main spring 18. In this manner, the opening of the delivery valve is caused.

This allows the outlet, towards the nozzle, of the compressed air present in the compression chamber with the initial actuations of the pump, thus allowing a facilitated priming of the pump itself.

It should be observed that in this embodiment, the end stop of the piston is determined by the contact between the button and the bottom—while the cylindrical element 7 in which the seat of the suction valve is obtained, and the wall 140 that defines the seat of the delivery valve, given that they are rather delicate elements, never come into contact with each other.

This characteristic is extremely important since the end stop of the piston is achieved between two structurally rigid elements, and hence the lip 11A of the piston—an extremely delicate part—never comes into contact with the bottom surface of the cup-shaped body (i.e. of the step 3D), thus preventing deformations.

Preferably, in such embodiment, the first seat 9 is in a raised position with respect to the bottom of the cup-shaped body and projecting towards the delivery valve 14/16. The seat 14 of the delivery valve is instead in a more raised position with respect to the sealing lip 11A of the piston.

Figure 2:
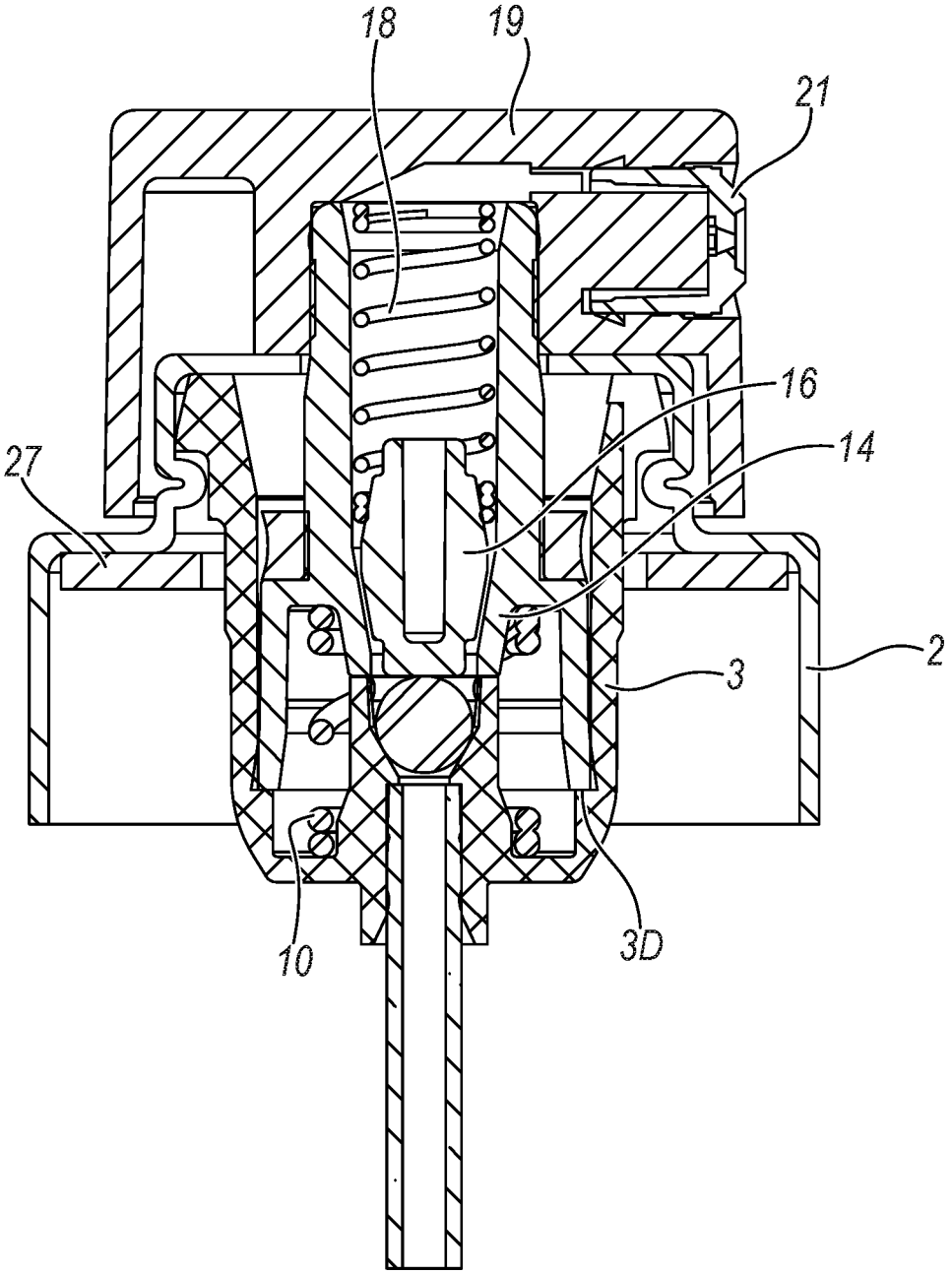
FIG. 2 is a section view of the pump of FIG. 1, when it is in a lower end of travel position.
Figure 3:
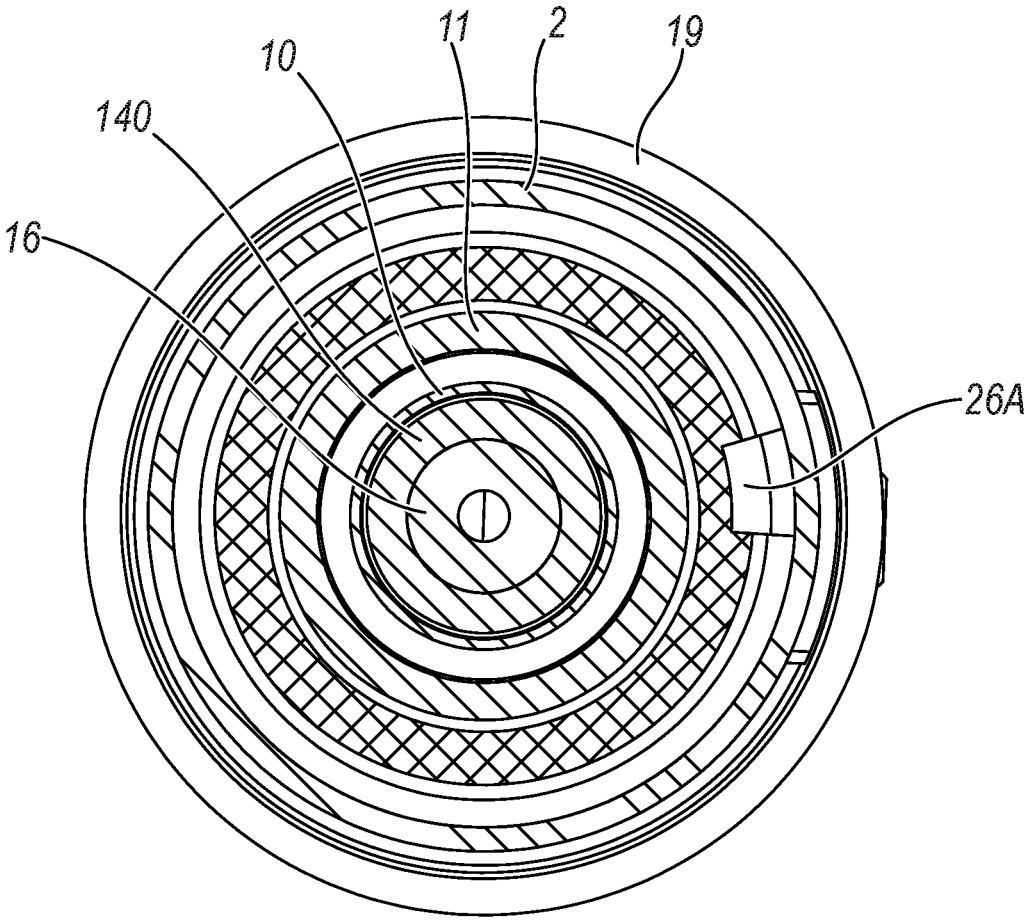
FIG. 3 is a cross section view, taken along the line 3-3 of FIG. 1.

From that described above, the operation of the invention appears evident for the man skilled in the art and there is no need to discuss it further since the pump is represented in FIG. 1 in a rest position and in FIG. 2 in an end of travel position.

It should only be observed that during the travel of the piston, the gasket 22 is detached from the ring nut or bottom, thus allowing the outside air to enter within the container (venting), first through an annular slit that is created between the bottom (or ring nut) and the stem, continuing through the notch 26A obtained in the annular abutment of the cup-shaped body 3.

In addition, the above-described pump is extremely inexpensive since it is obtained with a very limited number of suitably molded pieces. The suitably molded pieces (cup, stem/piston and movable element 16) are all easily obtained via molding of plastic material, while all the other components are standard and commonly used on pumps. They are thus normally present on the market and easy to find.

Furthermore, the assembly of the pump results extremely simple, as is inferred from the mounting procedure described hereinbelow.

First of all, arranged on the work holders are the gasket 27 and subsequently the cup-shaped body 3, which when inserted in the gasket slightly deforms it in a manner such that the same remains constrained thereto.

The sphere is then positioned in the first seat 9, and subsequently the return spring 10 is positioned inside the cup-shaped body. It should be observed that the spring, simply cast in the cup-shaped body, is automatically positioned around the boss 7 that projects from the bottom of the cup-shaped body 3.

Then, the piston/stem is inserted in the cup-shaped body and the gasket 22 is fit on the stem.

At this point, the movable element 16 is placed in the stem. It is automatically oriented and by virtue of its "functional symmetry" it does not matter if the opening of the lightening hole is directed upward or downward. In addition, the keg-shaped form, with the conical surfaces, renders the correct positioning in the seat 14 practically automatic. The main spring 18 is subsequently inserted. The gasket is positioned and the bottom 2 is fit on the cup-shaped body, and the seam 2*c* is executed.

Finally, the dispenser button 19 is fit on the stem, and the drawing tube 5 is inserted in the suitable seat.

As can be seen from the above-described operations, the mounting of the described pump is extremely simple. The considerable advantage obtained by the use of a spherule and an automatically orientable movable element, in place of other valve means, lies in the obtainment of an even quicker mounting, which decreases the cost of the pump.

Finally, it should be noted that such pump is extremely reliable.

The particular trigger mechanism which provides for the contact between the movable element 16 and the sphere of the suction valve is very effective and quite reliable.

In addition, the expulsion of air and a negligible amount of product at the end of travel occurs in the natural direction of dispensing of the substance contained in the container, thus preventing the onset of any type of problem.

Furthermore, as can be observed in the drawings, the return spring results perfectly centered on the lower part by the boss 7 and on the upper part by the projecting portion inside the chamber 15 of the seat 14 of the delivery valve. This ensures that, during the use of the pump, the spring always remains perfectly centered and in position, increasing the overall reliability of the pump.

It should also be observed that in the present pump, the spherule of the suction valve in its operating movement is confined laterally by the return spring, on the upper part by the lower portion of the seat of the delivery valve, and on the lower part by the seat of the suction valve. Other projections, bosses, tabs and the like would therefore not be necessary in order to maintain the sphere in position, with savings on the molding costs of the cup-shaped body. Advantageously, however, for safety purposes, small projections 9A are still obtained in the seat 9 of the suction valve. Such projections are deformed upon the insertion of the sphere in its seat, and here they confine the sphere during the suction action, hence allowing the passage of the product flow that fills the compression chamber.

With reference to the particular configuration of the movable element 16 of the delivery valve, it should be noted that the opening angle $\gamma$ of the conical surface (which is actually the angle formed by the intersection of two lines A and B parallel to or abutted against the external surface of the valve element 16, belong to and intersect on a plain that contains the axis C of the valve element) allows the valve element 16 to 'be fit' in its seat 14, which preferably has a form similar (corresponding) to the conical form of the element 16.

The conical joint, which is achieved as the main spring 18 presses against the element 16, also as a function of time, provides a perfect seal of the valve that it does not lose even when facing severe reduced pressure tests.

In addition, the presence of the blind hole in the movable element facilitates a very slight deformation of the conical walls of the movable element itself, when it is inserted in the seat, improving even more the 'joining' capacity.

Given the presence of the joint made between two conical surfaces, unlike that which occurs for conventional ball valves, it is not necessary to equip the pump with a spring with very high elastic constant; this fully benefits the 'ease' of actuating the button, which is clear after having overcome a first force peak necessary for decoupling the joint.

As can be seen in the graph 10, which shows the force to actuate for the subsequent dispensing, such peak is much lower, once the pump has been actuated for the first time.

Figure 7:
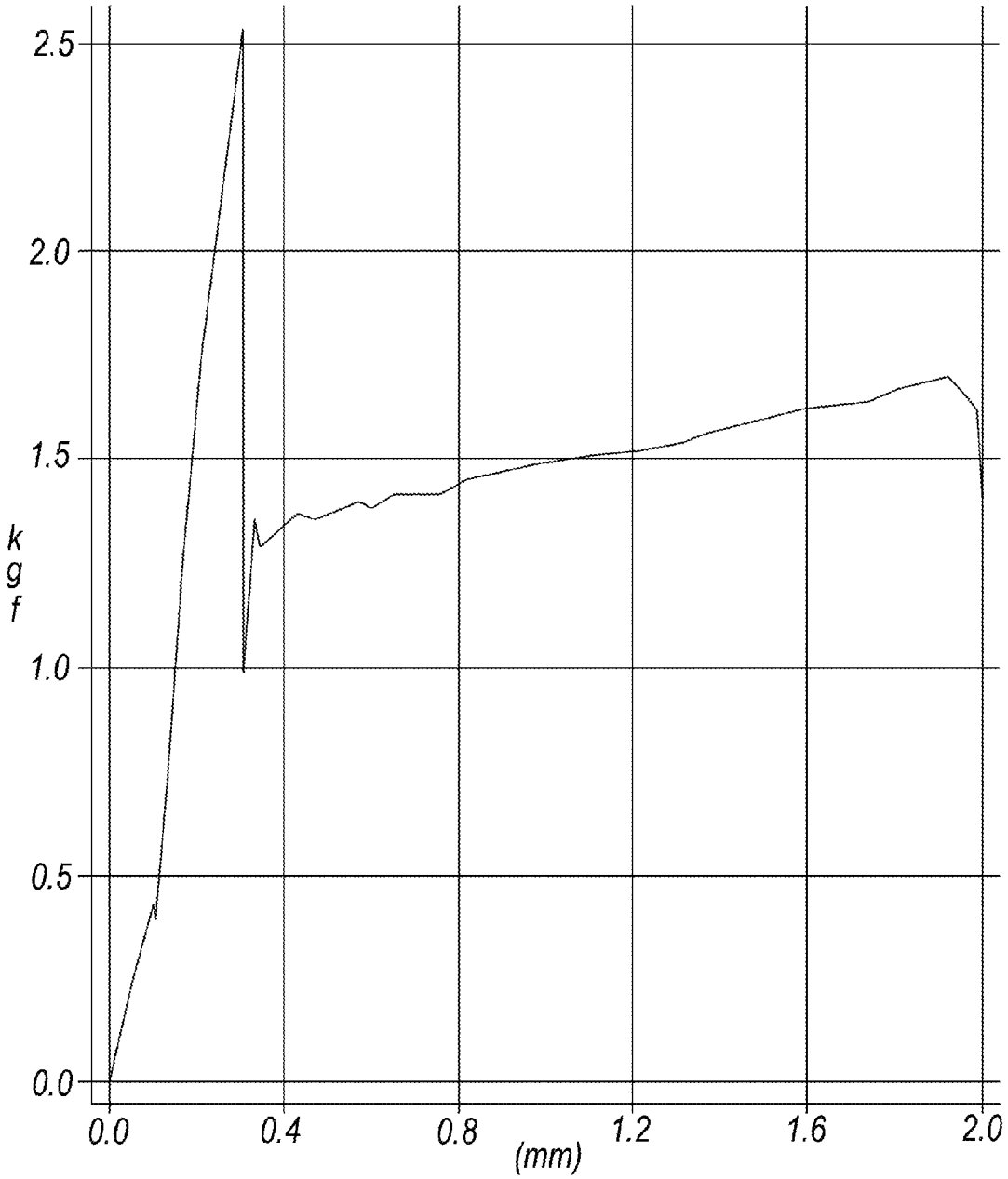
FIG. 7 shows a graph of the force to actuate the pump of FIG. 1, provided with an opening of the conical surface equal to 20°.
Figure 8:
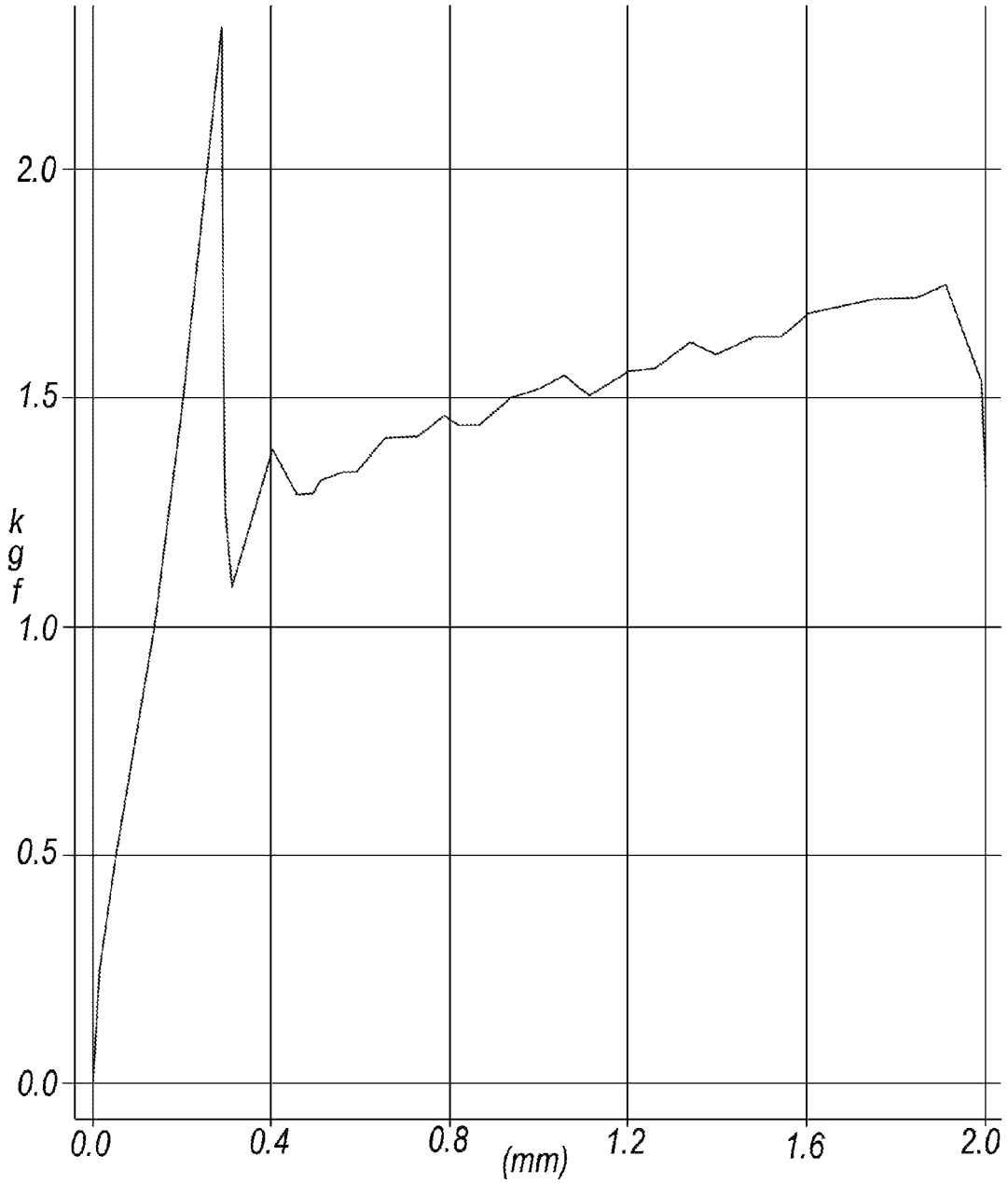
FIG. 8 shows a graph of the force to actuate a pump similar to that of FIG. 1 when the opening of the conical surface is equal to 22°.
Figure 9:
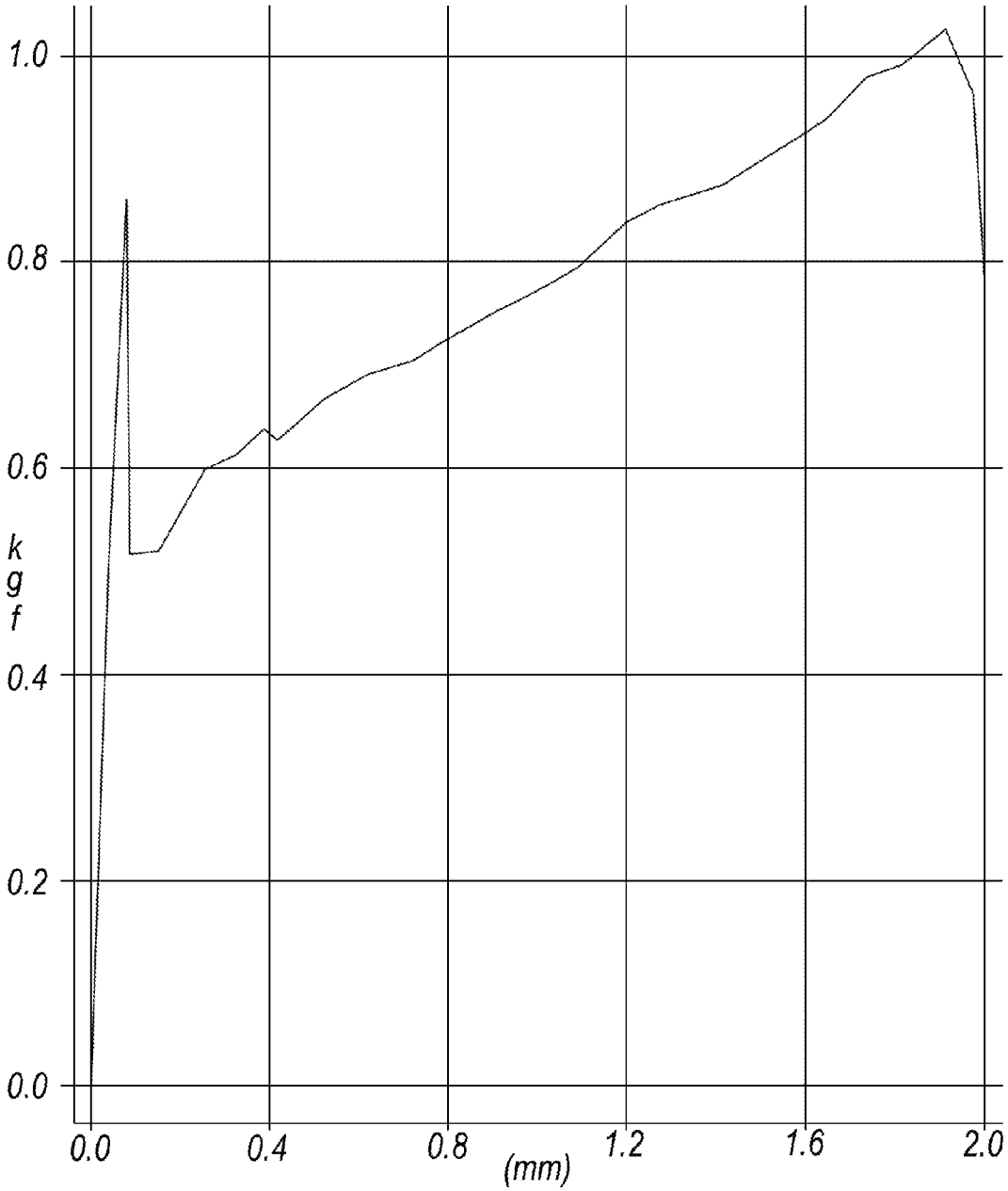
FIG. 9 shows a graph of the force to actuate a pump similar to that of FIG. 1 when the opening of the conical surface is equal to 25°.
Figure 10:
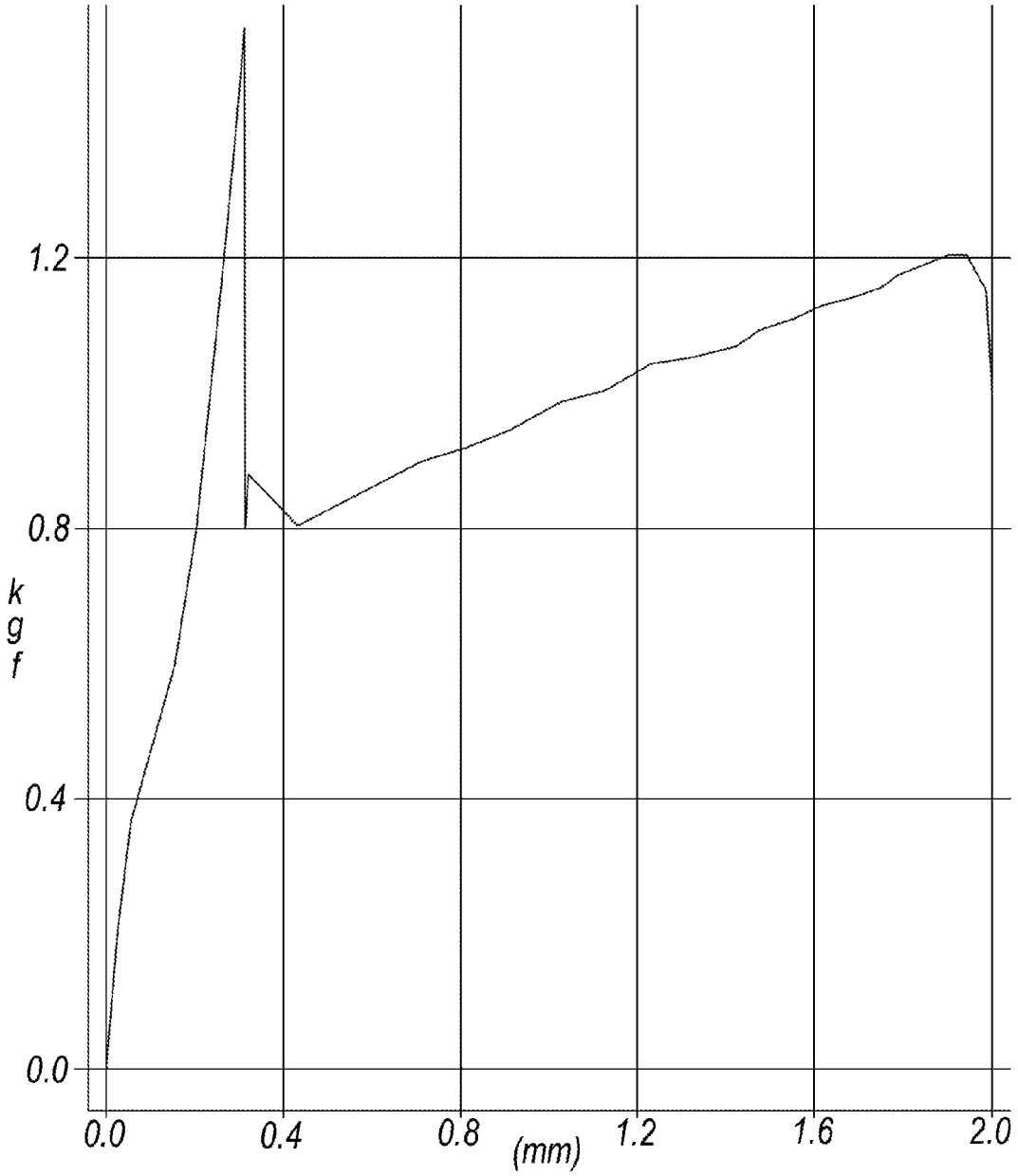
FIG. 10 shows a graph of the force to actuate the pump of FIG. 1, after the first actuation which is illustrated in the graph of FIG. 7.

The advantage that is obtained in the use of the conical coupling between the valve element 16 and the seat 14 is clear from the analysis of the graph present in FIG. 7, referred to an opening of the cone of 20°.

As is seen during the first dispensing of the pump (after the same has been left to rest for a period of time), it is necessary to exert a force with a peak of about 2.5 kgf, but which then quickly descends to a value that remains around 1.5 kgf (an entirely acceptable value that provides an easy-to-move sensation).

In order to verify the optimal opening of the conical surface, many tests were performed that showed that an opening of the conical surface of the movable element 16 which is comprised between 17° (FIG. 6) and 22° (FIG. 8) is the best, with an optimal value of 20° (FIG. 7). Indeed, it is seen that within these intervals, the peak value determined by the fitting of the movable element in the seat is around 2.5 kgf, which is an acceptable value (the force decreases with the increase of the opening angle).

It is instead seen that for greater opening values (such as 25° of FIG. 9), the fitting effect is not very accentuated and practically useless, while for overly-low opening values (such as the 15° of FIG. 5) the movable element is fit too well, requiring a force greater than 3 kgf for the initial actuation (which is not tolerable).

It has thus been verified that a coupling obtained with a movable element provided with a conical surface with opening ranging from 22° to 17°, with an optimal opening at 20°, provides an optimal compromise between vacuum sealing and ease of actuation of the pump.

Of course, in the above-described embodiments, also the seat in which the movable element makes a seal can be provided with a conical surface for the coupling with the surface of the movable element; in such case, the opening of such surface will be equal to that of the movable element or only slightly wider.

Various embodiments of the invention have been described, but other embodiments can be conceived by exploiting the same innovative concept.

The invention claimed is:

1. A manually operated pump for dispensing a fluid substance contained inside a container to which said pump can be associated, the pump comprising:

a cup-shaped body provided on its bottom with an opening that can be associated with a drawing tube inside said container and with a spherule housed in a first seat adapted to act as a suction valve, a piston being sealingly slidable inside the cup-shaped body in opposition to a return spring, a hollow stem being extended from such piston, one end of such stem projecting towards the exterior of the cup-shaped body, the hollow stem housing in a second seat a movable element of a delivery valve loaded by a spring, the second seat having a surface and an opening therethrough sealable by the movable element, the pump having a bottom or ring nut for fixing to said container, the bottom or ring nut being provided with a hole through which said stem passes and configured to couple with said cup-shaped body, wherein the movable element of the delivery valve has an external surface substantially formed by two functionally symmetrical parts joined at a transverse plane of the movable element, each part having a conical surface and tapered end, wherein the tapered end includes a step formed between the conical surface and tapered end, wherein one of the conical surfaces is configured to form a seal with the surface of said second seat and one of the tapered ends is spaced apart from the surface of the second seat by the step and the tapered end projects through the opening in the second seat, in a manner such that due to the action of said spring, the movable element can be fit in said second seat.

2. The pump according to claim 1, wherein said conical surface has an angle about an axis C between about 17° and about 22°.

3. The pump according to claim 1, wherein also the surface of said seat is at least partially conical, with an angle between about 17° and about 22°.

4. The pump according to claim 1, wherein said movable element has an axial blind hole for lightening in one of the tapered ends.

5. The pump according to claim 1, wherein said first seat is in a raised position with respect to the bottom of the cup-shaped body and projecting towards the delivery valve.

6. The pump according to claim 5, wherein said first seat is obtained at the top of an internally hollow cylindrical boss, which is extended from the bottom of the cup-shaped body.

7. The pump according to claim 1, wherein said first seat has a frustoconical conformation converging towards the bottom of the cup-shaped body.

8. The pump according to claim 1, wherein the second seat is obtained at a portion in which said stem is connected to said piston.

9. The pump according to claim 1, wherein the piston and the stem are made in a single piece.

10. The pump according to claim 1, wherein on one free end of the stem, a dispenser cap is fit that acts as an abutment for said main spring, said dispenser cap preferably having a spray nozzle.

11. The pump according to claim 1, wherein on the external surface of the stem, in proximity to the piston, a gasket is fixed adapted to provide a seal when it is in abutment against said bottom or ring nut.

12. The pump according to claim 1, wherein said bottom or ring nut is made by a shaped plate of metal material and said means for coupling with the cup-shaped body comprise a seam which cooperates with an annular abutment obtained at a free end of said cup-shaped body and/or wherein said annular abutment has a notch adapted to allow the passage of air from the outside to the inside of the container, at least when said gasket is detached from said ring nut, and/or wherein the movement of the spherule is limited laterally by said return spring, on the upper part by the lower portion of the seat of the delivery valve, and on the lower part by the seat of the suction valve.

* * * * *